US005314113A

United States Patent [19]

Irigoite et al.

[11] Patent Number: 5,314,113

[45] Date of Patent: May 24, 1994

[54] SUPPORT FOR CONSUMPTION OF ELONGATED FOODS

[75] Inventors: Fabio Irigoite; Breno S. Mallmann, both of Porto Alegre, Brazil

[73] Assignee: Grupoutil Desenvolvimento de Produtos de/Utilidade Ltda., Porto Alegere, Brazil

[21] Appl. No.: 953,649

[22] Filed: Sep. 29, 1992

[51] Int. Cl.[5] ..... B65D 5/46

[52] U.S. Cl. ..... 229/117.12; 229/108; 229/938; 426/115

[58] Field of Search ..... 229/117.12, 108, 108.1, 229/190, 195, DIG. 13; 426/115

[56] References Cited

U.S. PATENT DOCUMENTS

| | | | |
|---|---|---|---|
| 2,011,383 | 8/1935 | Taylor | 229/DIG. 13 |
| 2,128,342 | 8/1938 | Zalkind | 229/195 X |
| 2,335,197 | 11/1943 | Ringler | 229/195 X |
| 3,094,264 | 6/1963 | Petrone | 229/DIG. 13 |
| 4,940,190 | 7/1990 | Groves | 229/DIG. 13 |
| 5,129,521 | 7/1992 | Irigoite et al. | 229/DIG. 13 |

FOREIGN PATENT DOCUMENTS

| | | | |
|---|---|---|---|
| 317788 | 11/1969 | Sweden | 229/DIG. 13 |

*Primary Examiner*—Allan N. Shoap
*Assistant Examiner*—Christopher J. McDonald
*Attorney, Agent, or Firm*—McGlew and Tuttle

[57] ABSTRACT

A support for consumption of an elongated food such as hot dogs is a simple structure starting with fold lines and cuts in a sheet of flexible and impermeable material such as paper, plastic coated paper or plastic sheet. It comprises a substantially rectangular base with a rear section defining a vertex from which side walls are attached. One side wall is provided with a cut and another side wall is provided with an indentation and a fold line in its middle section. This side wall has approximately twice the length of the first side wall.

2 Claims, 2 Drawing Sheets

SUPPORT FOR CONSUMPTION OF ELONGATED FOODS

FIELD OF THE INVENTION

The present invention refers to a support capable to be used in consuming elongated foods, such as hot-dogs, which use the technique of retraction of the base, facilitating the consuption operation, mainly in relation to hygiene.

SUMMARY AND OBJECTS OF THE INVENTION

More specifically, the support, object of this invention comprises a simple structure starting with folding and cuttings in a sheet of flexible material, such as paper, plastified paper, plastic sheet, among others. The referred support comprises a base of rectangular shape, which rear section is defined by a vertex from which walls arise, one side wall being provided with a cutting and the other side wall, having a longer length, is provided with an indentation and a folding line.

In order that the support becomes fixed, one of the side walls has a straight cut in parallel to the folding of the said wall. Complementary, the other wall presents an indentation designed to penetrate in the mentioned cut in this way causing the side walls to maintain their position for use.

After the assembly, the said walls produce a region with a transverse section of triangular shape, the region where the rear part of the food being eaten will rest.

The said food is fixed to the support by pressure exerted by the user, intending to aproximate the said walls, in such a way that the food will be placed on the base with its rear portion placed on the middle portion of the mentioned walls. The eating per sa is effected from the retraction of the base, by means of a folding, thus exposing only part of the food, in this way a secure and mainly a hygienic consuption is secured.

BRIEF DESCRIPTION OF THE DRAWINGS

The understanding of the present invention will be made clearer by means of the attached figures in which.

DETAILED DESCRIPTION OF THE PREFERRED EMBODIMENTS

Figure 1:
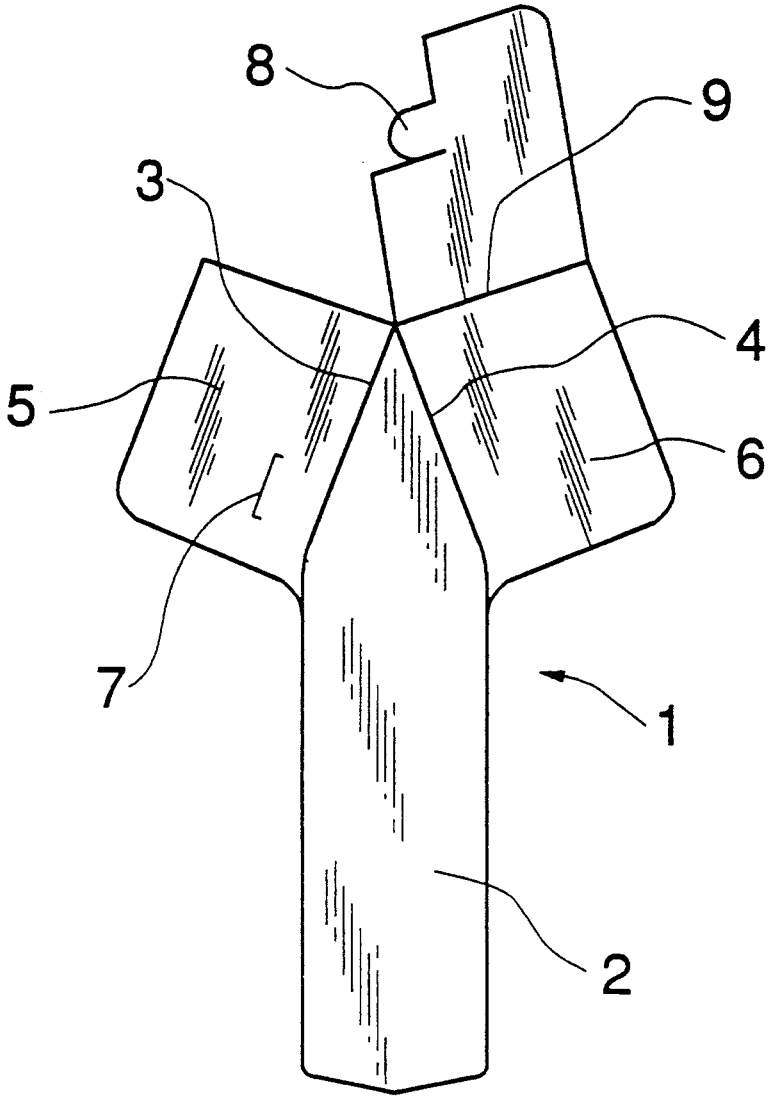
FIG. 1 is a view from the above of the sheet from which the object of the present invention will be produced, before its assembly.
Figure 2:
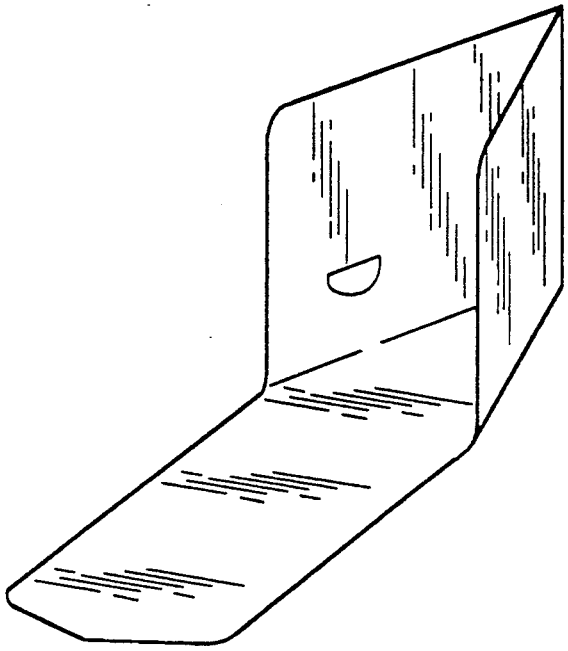
FIG. 2 is a view in perspective of the support, object of the presente invention, after its assembly.

Studing the figures it can be verified that the support (1) comprises a base (2), basically in a retangular shape, which rear section defines a vertex, from which side walls (5) and (6) arise, in such a way that wall (5) is provided with a cutting (7), and the side wall (6) is provided with an indentation (8) and a folding line (9) in its middle section, this side wall (6) being aproximately twice as long as wall (5).

To assemble the support (1), object of this invention, the side walls (5, 6) are folded on lines (3, 4) in such a way that they remain perpendicular to the base (2), and then side wall (6) is folded at the folding line (9), until the folded section meets the side wall (5), and finally the indentation (8) is fitted into the cut (7) of said side wall (5).

The main advantage of the support (1) object of the present invention is in its use, insofar that rear section of the support is capable of holding firmly the food to be eaten, while the transverse disposition of said walls allow the gradual removal of the food, which makes the consumption of the last portion of the food easier. Besides the above shown advantages it may be complementarly stated that the support (1) object of present invention, in view of its peculiar shape, presents a low consumption of material for its production, as well as due to the fact of presenting only three folding lines (3, 4, 9) and three distinct regions (2, 5, 6) its assembly becomes fast and easy, this fact combined to the hygiene given by the support, makes its use adequate for the fast food commercial outlets.

While a specific embodiment of the invention has been shown and described in detail to illustrate the application of the principles of the invention, it will be understood that the invention may be embodied otherwise without departing from such principles.

We claim:

1. A support for consumption of elongated foods, comprising:

a flexible and impermeable material element comprising a base of a substantially rectangular shape including a front section with a front edge; a first side edge and a second side edge connecting to a rear section with converging fold lines defining a vertex;

a first side wall extending upwardly from a first of said converging fold lines and a second side wall extending upwardly from a second of said converging fold lines, said first side wall including a cut slot and said second side wall including an indentation on a flap, a folding line provided in a middle section of said second side wall separating said flap from a remainder of said second side wall, said second side wall having a length approximately double a length of said first side wall, whereby said indentation is inserted in said cut slot.

2. A support for consumption of elongated food, comprising:

a flexible and impermeable material element including an elongate base having a substantially rectangular front portion providing a free end with a front edge, a first side edge and a second side edge and a rear end portion with a first fold line and a second fold line, said fold lines extending respectively from said first side edge and said second side edge, said first fold line and said second fold line converging to form a vertex, said first side edge having a length longer than said first fold line and said second side edge having a length longer than said second fold line;

a flexible first side wall portion connected to said base at said first fold line of said vertex and a flexible second side wall portion connected to said base at said second fold line of said vertex, said first wall portion including a cut slot, said second wall portion including a fold line extending from said vertex to divide said second side wall substantially in two and providing a flap portion, said flap portion including an indentation whereby said first side wall is folded upwardly from said base and said second side wall is folded upwardly from said base with said indentation positioned in said slot in order to maintain said flap substantially parallel with said first side wall portion.

* * * * *